US007766443B2

(12) United States Patent
Yoshida

(10) Patent No.: US 7,766,443 B2
(45) Date of Patent: Aug. 3, 2010

(54) IMAGE FORMING APPARATUS, METHOD OF COMPENSATING FOR ERROR OF CONVEYANCE DISTANCE OF RECORDING MEDIUM IN THE SAME AND COMPUTER READABLE MEDIUM PROVIDED IN THE SAME

(75) Inventor: Yasunari Yoshida, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 262 days.

(21) Appl. No.: 11/698,871

(22) Filed: Jan. 29, 2007

(65) Prior Publication Data

US 2007/0176954 A1 Aug. 2, 2007

(30) Foreign Application Priority Data

Jan. 27, 2006 (JP) ..... P2006-019155

(51) Int. Cl.
*B41J 29/38* (2006.01)

(52) U.S. Cl. ..... 347/16

(58) Field of Classification Search ..... 347/16
See application file for complete search history.

(56) References Cited

U.S. PATENT DOCUMENTS 6,439,684 B1 * 8/2002 Yoshimura et al. ..... 347/19
2002/0044290 A1 * 4/2002 Otsuki ..... 358/1.5
2002/0063871 A1 * 5/2002 Kinas ..... 358/1.4
2004/0061732 A1 4/2004 Masaru
2004/0066426 A1 * 4/2004 Yamada ..... 347/19
2004/0150686 A1 * 8/2004 Lee ..... 347/16
2004/0165023 A1 * 8/2004 Kang et al. ..... 347/16
2006/0209114 A1 * 9/2006 Namai ..... 347/16
2007/0076038 A1 * 4/2007 Plante et al. ..... 347/19

FOREIGN PATENT DOCUMENTS

JP 2004-50498 A 2/2004

* cited by examiner

*Primary Examiner*—Julian D Huffman
(74) *Attorney, Agent, or Firm*—McDermott Will & Emery LLP

(57) ABSTRACT

An image forming apparatus includes a feeding roller and a recording unit. The feeding roller is rotatably disposed to convey the recording medium in a conveying direction, and includes a rotational axle that is eccentric and a peripheral surface having an actual external dimension that is different from a theoretical external dimension. The recording unit has a head length in the conveying direction. A method of compensating for an error of a conveyance distance of a recording medium in the image forming apparatus includes (1) printing a first image on the recording medium; (2) rotating the feeding roller N turns, N being a positive integer; (3) printing a second image on the recording medium after the feeding roller has been rotated N turns; and (4) determining difference of the actual external dimension from the theoretical external dimension, based on both the first image and the second image.

12 Claims, 8 Drawing Sheets

IMAGE FORMING APPARATUS, METHOD OF COMPENSATING FOR ERROR OF CONVEYANCE DISTANCE OF RECORDING MEDIUM IN THE SAME AND COMPUTER READABLE MEDIUM PROVIDED IN THE SAME

BACKGROUND OF THE INVENTION

1. Field of the Invention

The present invention relates to a method of acquiring conveyance error in an image forming apparatus, an image forming apparatus acquirable conveyance error and an image forming apparatus control program for acquiring conveyance error in an image forming apparatus.

2. Description of Related Art

Conventional ink jet printers repeatedly cause an ink ejecting head to eject ink onto a recording medium while reciprocating the head in a main scanning direction, and conveys the recording medium in a sub scanning direction, in order to form an image on the recording medium.

The head has a plurality of ink jet ejection ports arranged in an array in the direction in which the recording medium is conveyed. The image forming apparatus is adapted to convey the recording medium at a rate that corresponds to the head length, which is the length of the array of the ink jet ejection ports in the direction of conveying the recording medium.

However, the head and a feeding roller for conveying the recording medium are often accompanied by a manufacturing error. The manufacturing error consequently causes a discrepancy from the theoretical value of the conveyance distance that is supposed to be observed when the head and the feeding roller are manufactured correctly. Therefore, as conventional practice, the discrepancy is detected before shipping the product and the theoretical value of the conveyance distance is corrected by taking the discrepancy into consideration at the time of actually conveying the recording medium so that the recording medium may be conveyed at the corrected conveyance distance. Additionally, the correction is made each time when a recording medium is conveyed. Then, as a result, the recording medium is conveyed to the theoretically right position to form an image with an excellent quality.

Japanese Patent Application Publication No. 2004-50498 discloses a method of preventing stripes from being produced on the printed image due to the manufacturing error in terms of the head and the feeding roller. The method disclosed in Japanese Patent Application Publication No. 2004-50498 detects the error of the conveyance distance based on the manufacturing error of the head and the feeding roller, and corrects the detected error.

SUMMARY OF THE INVENTION

However, it is difficult to detect the error if the feeding roller is eccentrically manufactured.

FIG. 1 is a graph illustrating how the conveyance error apparatus is detected in the conventional image forming. In FIG. 8, the horizontal axis A indicates the theoretical conveyance distance as expressed by using a unit of mm (millimeter), and the vertical axis indicates the error from the theoretical distance as expressed by using a unit of μm (micrometer). The term of theoretical distance as used therein refers to the distance by which the recording medium is conveyed when the feeding roller 60 is accurately manufactured to show the design dimension and has no eccentricity.

The solid line B shows the difference between the distance by which the recording medium is actually conveyed and the theoretical distance, while the dotted chain line C shows the difference between the distance by which the recording medium is conveyed when the feeding roller 60 has errors of the external dimensions but does not have any eccentricity and the theoretical distance. The solid line B is a sinusoidal curve with the centerline thereof agreeing with the dotted chain line C and the zero-crossing point a1 is selected as the starting point for detecting the conveyance error.

Thus, if a predetermined image is printed for the first time at the starting point a1 and the predetermined image is printed for the second time at point a2 that is separated from the starting point a1 by predetermined distance L2, the distance error d1 between the two images relative to the corresponding theoretical distance is obtained by actually measuring the distance between the two images. However, the distance error d1 may include the error attributable to the eccentricity of the feeding roller 60. In other words, the accurate distance error is e. Note that the zero-crossing point is selected as the starting point a1 for detecting the conveyance error in FIG. 8, the same error occurs when some other point is arbitrarily selected as the starting point a1.

In view of the above-identified problem, therefore, the object of the present invention is to provide a method for acquiring conveyance error in an image forming apparatus, an image forming apparatus acquirable conveyance error and an image forming apparatus control program for acquiring conveyance error in the image forming apparatus, even when the feeding roller is eccentric.

In order to attain the above and other objects, the present invention provides a method of compensating for an error of a conveyance distance of a recording medium in an image forming apparatus. The image forming apparatus includes a feeding roller and a recording unit. The feeding roller is rotatably disposed to convey the recording medium in a conveying direction. The feeding roller includes a rotational axle that is eccentric and a peripheral surface having an actual external dimension that is different from a theoretical external dimension and a peripheral length in the conveyance direction. The recording unit has a head length over which an image can be printed in the conveying direction. The method includes (1) printing a first image on the recording medium; (2) rotating the feeding roller N turns, N being a positive integer; (3) printing a second image on the recording medium after the feeding roller has been rotated N turns; and (4) determining difference of the actual external dimension from the theoretical external dimension, based on both the first image and the second image.

Another aspect of the present invention provides a method of compensating for an error of a conveyance distance of a recording medium in an image forming apparatus. The image forming apparatus includes a feeding roller and a recording unit. The feeding roller is rotatably disposed to convey the recording medium in a conveying direction. The feeding roller includes a rotational axle that is eccentric and a peripheral surface having an actual external dimension that is different from a theoretical external dimension and a peripheral length in the conveyance direction. The recording unit has a head length over which an image can be printed in the conveying direction. The method includes (1) printing a first image on the recording medium; (2) rotating the feeding roller n turns; (3) printing a second image on the recording medium after the feeding roller has been rotated n turns; (4) rotating the feeding roller (N−0.5) turns from a position at which the feeding roller is when the first image is printed, N being a positive integer; (5) printing a third image on the recording medium after the feeding roller has been rotated (N−0.5) turns; (6) rotating the feeding roller n turns after the third image has been printed; (7) printing a fourth image on the recording medium after the third image has been printed and the feeding roller has been rotated n turns; (8) determining a first difference of the actual external dimension from the theoretical external dimension based on both the first image and the second image; (9) determining a second difference of the actual external dimension from the theoretical external dimension based on both the third image and the fourth image; and (10) determining difference of the actual external dimension from the theoretical external dimension based on both the first difference and the second difference.

Another aspect of the present invention provides an image forming apparatus includes a feeding roller, a recording unit, a first controller, and a second controller. The feeding roller is rotatably disposed to convey a recording medium in a conveying direction. The conveying roller includes a rotational axle that is eccentric and a peripheral surface having an actual external dimension that is different from a theoretical external dimension and a peripheral length in the conveyance direction. The recording unit has a head length over which an image can be printed in the conveying direction. The first controller controls the recording unit to print a first image on the recording medium. The second controller controls the feeding roller to rotate N turns, N being a positive integer, and controls the recording unit to print a second image on the recording medium after the feeding roller has been rotated N turns.

Another aspect of the present invention provides an image forming apparatus including a feeding roller, a recording unit, a first controller, a second controller, a third controller, and a fourth controller. The feeding roller is rotatably disposed to convey a recording medium in a conveying direction. The conveying roller includes a rotational axle that is eccentric and a peripheral surface having an external dimension that is different from a theoretical external dimension and a peripheral length in the conveyance direction. The recording unit has a head length over which an image can be printed in the conveying direction. The first controller controls the recording head to print a first image on the recording medium. The second controller controls the feeding roller n turns, and controls the recording unit to print a second image on the recording medium after the feeding roller has been rotated n turns. The third controller controls the feeding roller to rotate (N−0.5) turns from a position at which the feeding roller is when the first image is printed, N being a positive integer, and controls the recording unit to print a third image on the recording head after the feeding roller has been rotated (N−0.5) turns. The fourth controller controls the feeding roller to rotate n turns, and controls the recording unit to print a fourth image on the recording medium after the third image has been printed and the feeding roller has been rotated n turns.

Another aspect of the present invention provides a computer readable medium provided in an image forming apparatus. The image forming apparatus includes a feeding roller and a recording unit. The feeding roller is rotatably disposed to convey the recording medium in a conveying direction. The feeding roller includes a rotational axle that is eccentric and a peripheral surface having an actual external dimension that is different from a theoretical external dimension and a peripheral length in the conveyance direction. The recording unit has a head length over which an image can be printed in the conveying direction. The computer readable medium includes (1) a program for printing a first image on the recording medium; (2) a program for rotating the feeding roller N turns, N being a positive integer; (3) a program for printing a second image on the recording medium after the feeding roller has been rotated N turns; and (4) a program for determining difference of the actual external dimension from the theoretical external dimension, based on both the first image and the second image.

Another aspect of the present invention provides a computer readable medium in an image forming apparatus. The image forming apparatus includes a feeding roller and a recording unit. The feeding roller is rotatably disposed to convey the recording medium in a conveying direction. The feeding roller includes a rotational axle that is eccentric and a peripheral surface having an actual external dimension that is different from a theoretical external dimension and a peripheral length in the conveyance direction. The recording unit has a head length over which an image can be printed in the conveying direction. The computer readable medium includes (1) a program for printing a first image on the recording medium; (2) a program for rotating the feeding roller n turns; (3) a program for printing a second image on the recording medium after the feeding roller has been rotated n turns; (4) a program for rotating the feeding roller (N−0.5) turns from a position at which the feeding roller is when the first image is printed, N being a positive integer; (5) a program for printing a third image on the recording medium after the feeding roller has been rotated (N−0.5) turns; (6) a program for rotating the feeding roller n turns after the third image has been printed; (7) a program for printing a fourth image on the recording medium after the third image has been printed and the feeding roller has been rotated n turns; (8) a program for determining a first difference of the actual external dimension from the theoretical external dimension based on both the first image and the second image; (9) a program for determining a second difference of the actual external dimension from the theoretical external dimension based on both the third image and the fourth image; and (10) a program for determining difference of the actual external dimension from the theoretical external dimension based on both the first difference and the second difference.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
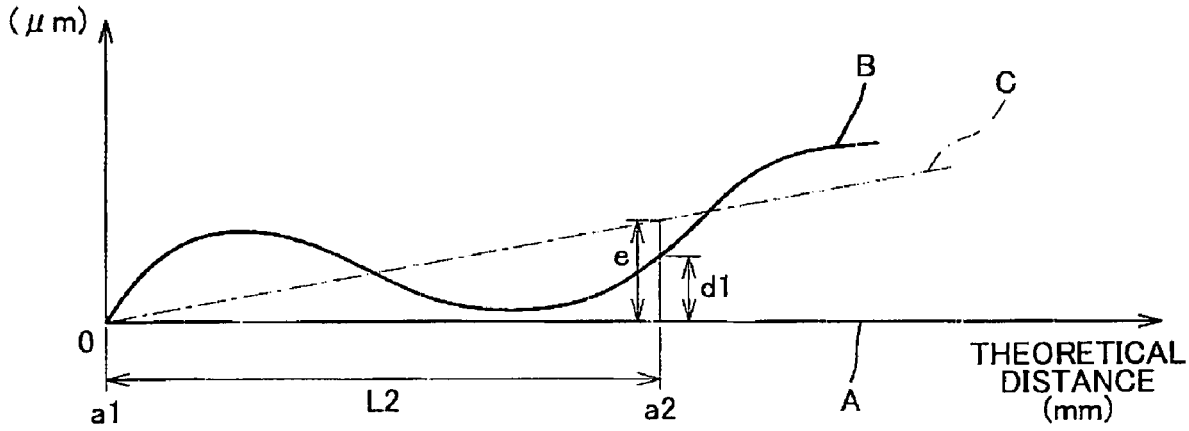
FIG. 1 is a graph showing conveyance error of a conventional image forming apparatus.

An image forming apparatus according to preferred embodiments of the present invention will be described while referring to the accompanying drawings wherein like parts and components are designated by the same reference numerals to avoid duplicating description.

In the following description, the expressions "front", "rear", "upper", "lower", "right", and "left" are used to define the various parts when the image forming apparatus is disposed in an orientation in which it is intended to be used.

Figure 2:
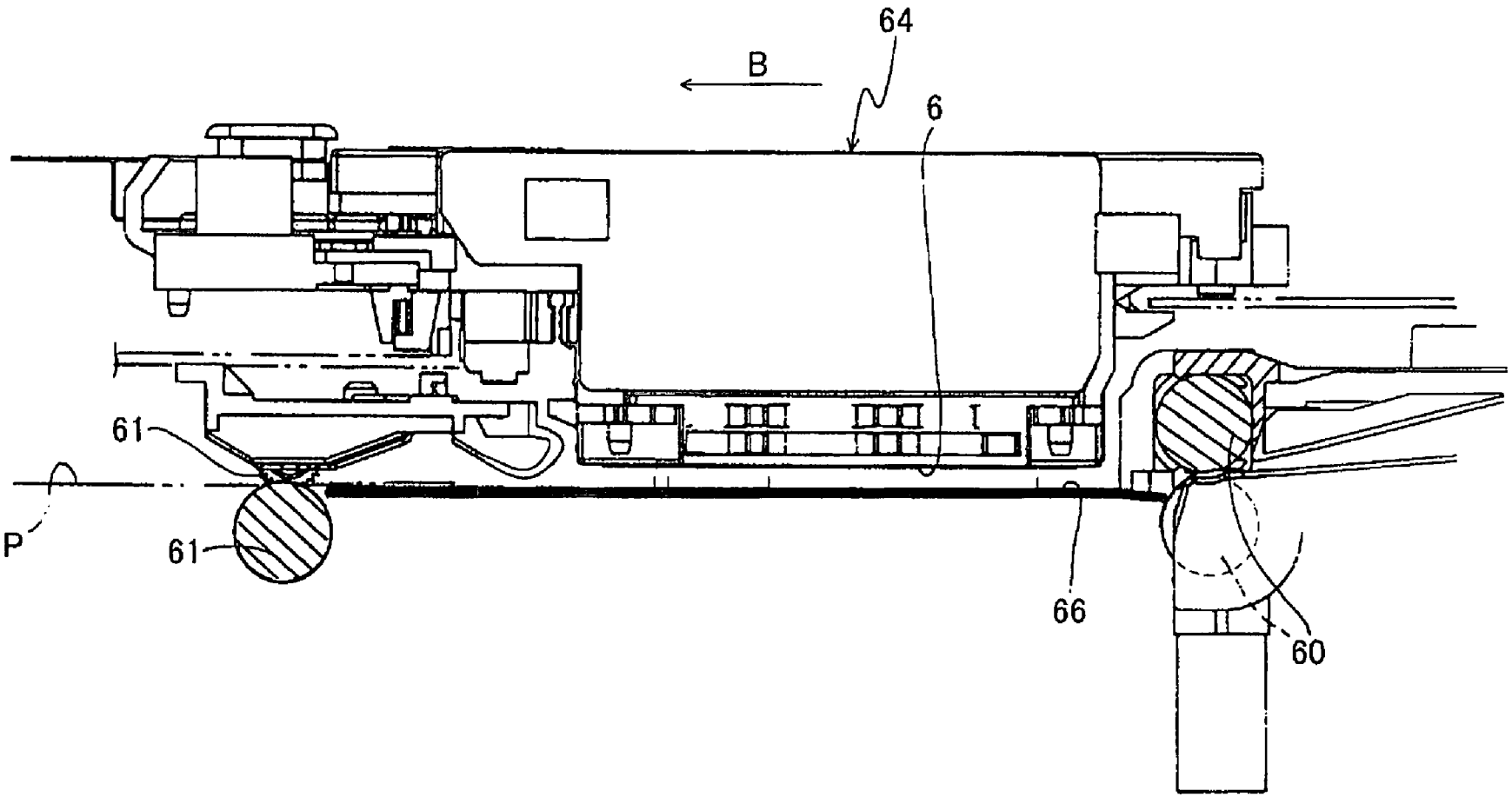
FIG. 2 is a schematic lateral view of a head section and a conveyance section of a color ink jet printer of the first embodiment.

FIG. 2 is a schematic lateral view of the head section and the conveyance section of the color ink jet printer 1 that is the image forming apparatus of the present invention. The head section of the color ink jet printer 1 includes an ink jet head 6 for printing an image on recording medium P and a carriage 64 mounting the ink jet head 6. The conveyance section includes a platen 66 arranged opposite to the ink jet head 6, a pair of feeding roller 60 for conveying the recording medium P while pinching the recording medium P between them, and a pair of delivery roller 61 for conveying the recording medium P while pinching the recording medium P between them. The recording medium P may be a sheet of paper such as ordinary paper or glossy paper or a sheet of cloth.

The carriage 64 is driven to rotate forwardly and backwardly by a CR motor (see FIG. 4) and reciprocate in a direction perpendicular to (to the drawing) the sheet feeding direction (as indicated by arrow B).

The recording medium P is fed from a sheet feeding cassette (not shown) of the color ink jet printer 1 and conveyed to between the lower surface 6*a* (FIG. 3) of the ink jet head 6 and the platen 66 in the direction of arrow B (the sub-scanning direction: a direction perpendicular to a main scanning direction A) through the feeding roller 60. An image is printed on the recording medium P by the ink ejected from a plurality of nozzles 53 (FIG. 3) formed in the ink jet head 6 and then the recording medium P is discharged by the delivery roller 61.

Figure 3:
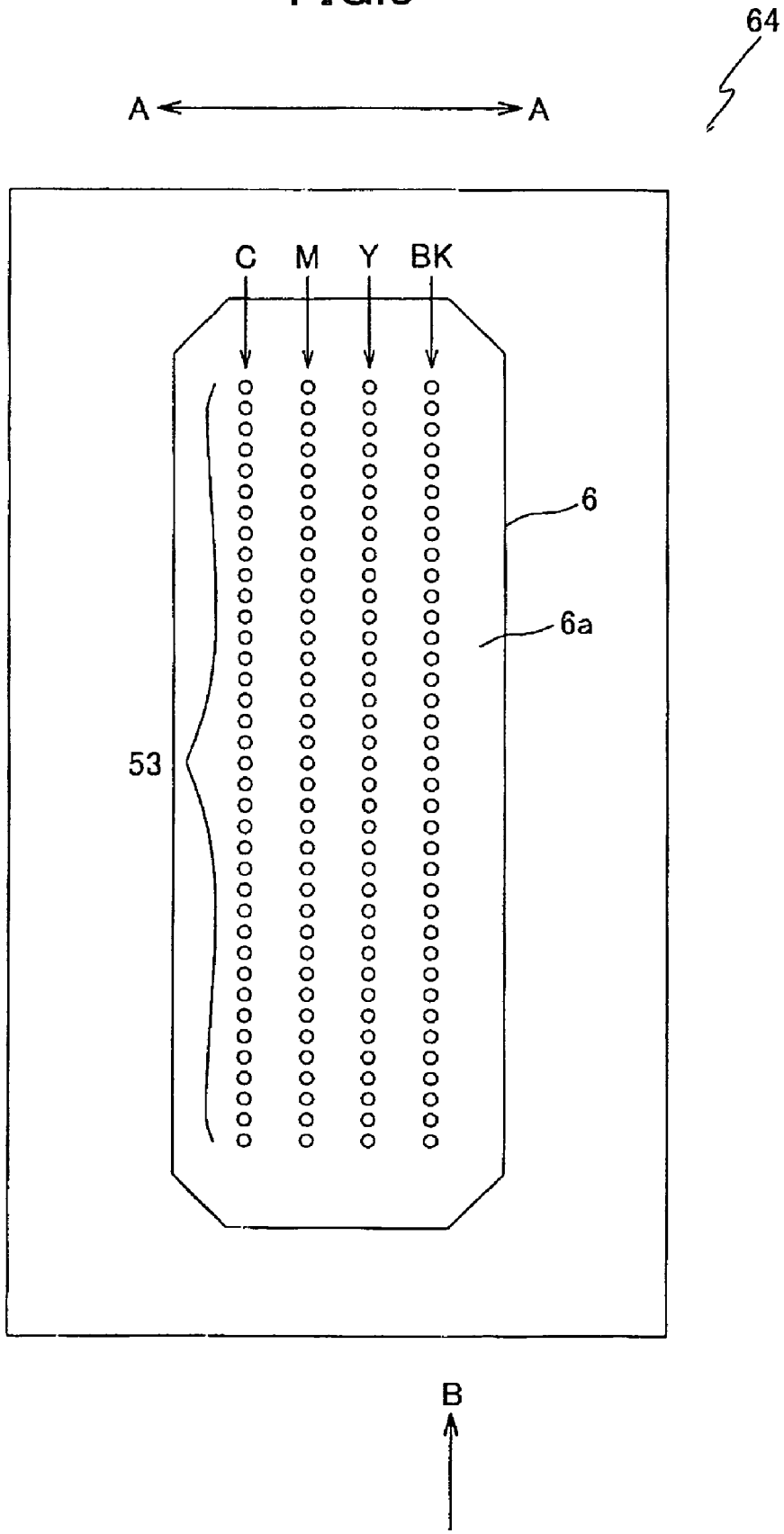
FIG. 3 is a schematic plan view of an ink jet head.

Now, the ink jet head 6 will be described in greater detail by referring to FIG. 3. As shown in FIG. 3, the nozzles 53 are arrayed on the lower surface 6*a* of the ink jet head 6 to form a row for each ink color of cyan, magenta, yellow and black in the conveyance direction B of conveying the recording medium P. The pitch of arrangement of nozzles 53 and the number of nozzles 53 in the direction of arrangement are selected appropriately according to the resolution of the image to be recorded. The number of rows of the nozzles 53 can be increased or decreased according to the number of types of color ink. The length in the conveyance direction B of a range in which the plurality of nozzles 53 is arrayed is referred to as nozzle length hereinafter.

Figure 4:
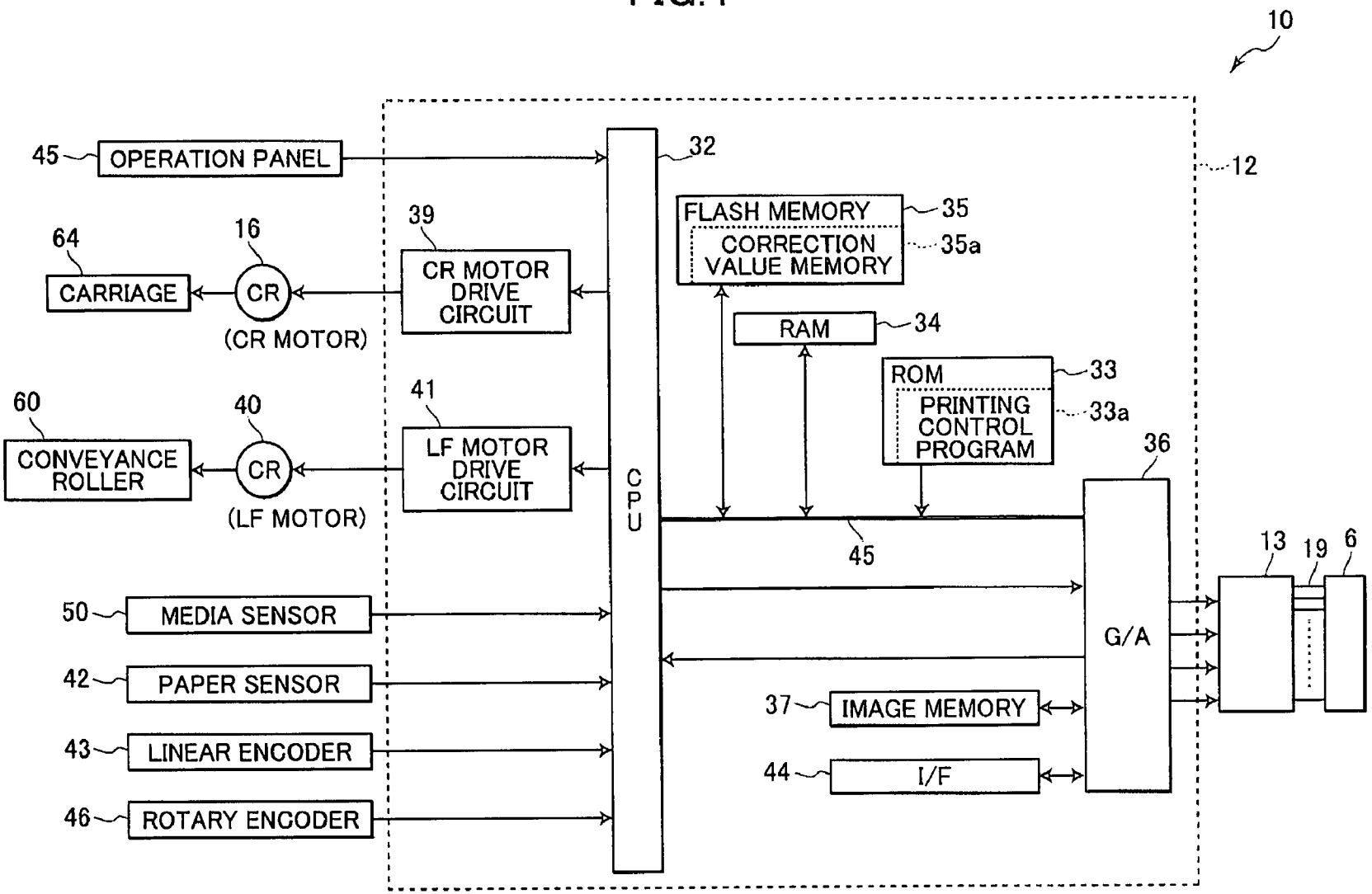
FIG. 4 is a schematic block diagram of an electric circuit of the color ink jet printer.

Now, the configuration of the electric circuit of the color ink jet printer 1 will be described by referring to FIG. 4. FIG. 4 is a schematic block diagram of the color ink jet printer 1, showing the configuration of the electric circuit thereof. The control apparatus for controlling the color ink jet printer 1 includes a main body side control substrate 12 and a carriage substrate 13. A microcomputer (CPU) 32 realized as a single chip, a ROM 33 storing the various control programs to be executed by the CPU 32 and fixed value data, a RAM 34 for temporarily storing various data, a flash memory 35, an image memory 37, a G/A (gate array) 36 and other components are mounted on the main body side control substrate 12.

The CPU 32 that is a processing apparatus generates a printing timing signal and a reset signal according to the control program stored in the ROM 33 in advance and transfers the signals to the gate array 36, which will be described in greater detail hereinafter. The CPU 32 is connected to an operation panel 45 to be operated by the user to issue directives for printing, a CR motor drive circuit 39 for driving a carriage motor (CR motor) 16 for the purpose of operating the carriage 64, an LF motor drive circuit 41 for operating a conveyance motor (LF motor) 40 for driving the feeding roller 60, a media sensor 50, a paper sensor 42, a linear encoder 43 and a rotary encoder 46. These devices are controlled by CPU 32.

The paper sensor 42 is sensor for detecting the front edge of the recording medium P that is arranged at the upstream side relative to the feeding roller 60 in a conveying direction. The paper sensor 42, for example, includes a detector adapted to turn as the detector contacts the recording medium P and a photo-interrupter adapted to detect the turn of the detector. The linear encoder 43 is adapted to detect the distance of movement of the carriage 64. The reciprocal motion of the carriage 64 is controlled as a photo-interrupter (not shown) detects the encoded quantity of the linear encoder 43. The rotary encoder 46 is adapted to detect the extent by which the feeding roller 60 is rotated. A photo-interrupter (not shown) detects the encoded quantity of the rotary encoder 46 to control the feeding roller 60. In other words, the position to which the recording medium P is actually conveyed by the feeding roller 60 can be detected with a predetermined degree of accuracy by means of the rotary encoder 46.

Figure 7:
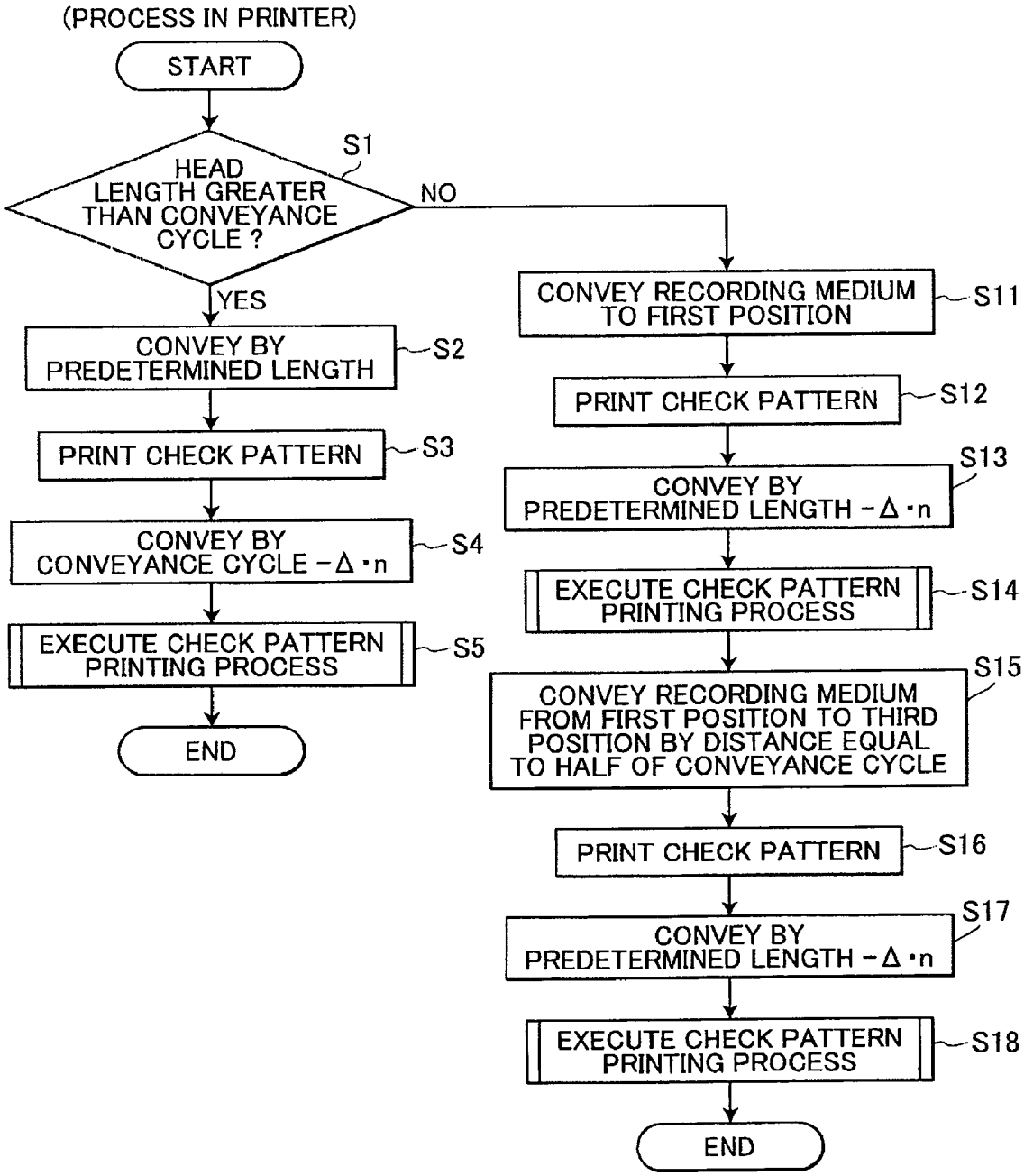
FIG. 7 is a flowchart showing a printing process for detecting the conveyance error.
Figure 8:
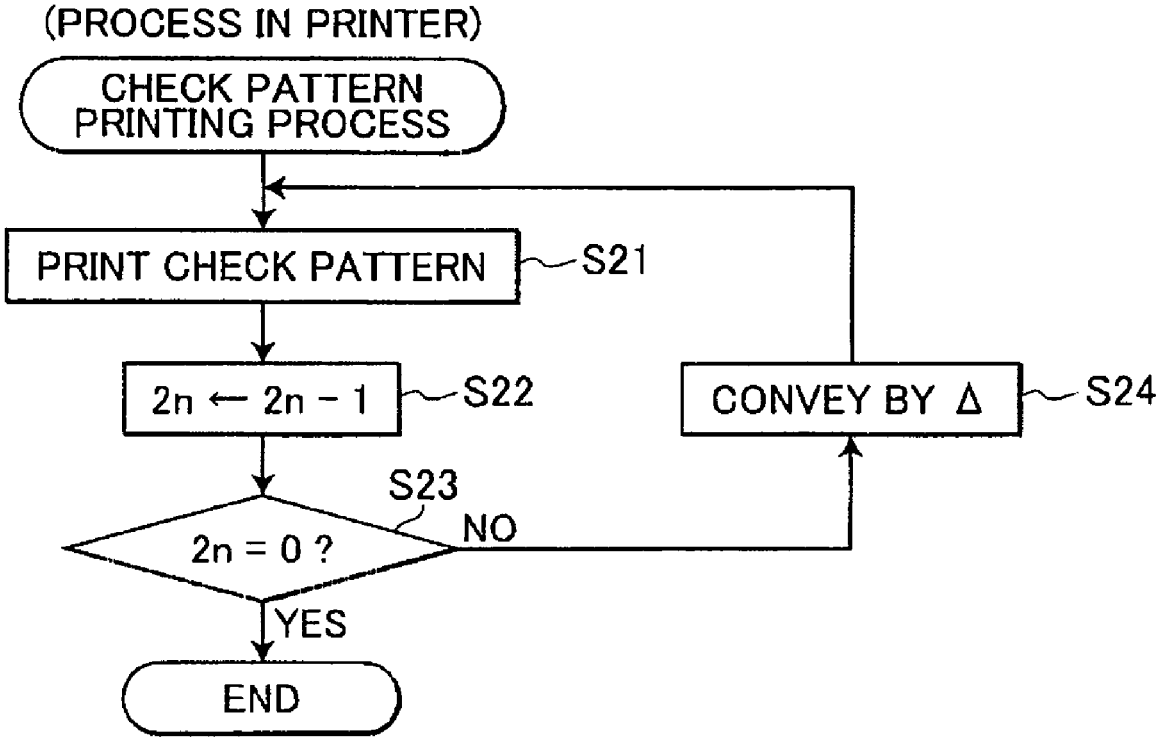
FIG. 8 is a flowchart showing a check pattern printing process.

The ROM 33 stores a printing control program 33*a* which is a program that executes a printing process which will be described in greater detail hereinafter (see FIGS. 7 and 8). The flash memory 35 includes a correction value memory 35*a*. The theoretical distance of conveyance for conveying the recording medium P and the discrepancy between the theoretical distance of conveyance and the actual detection of conveyance are determined in advance by pre-shipment test and stored in the correction value memory 35*a*. The flash memory 35 also includes a fixed value memory (not. shown) that stores as fixed values the control data for driving the feeding roller to make a full turn (of 360 degrees) or a half turn (of 180 degrees), the head length, the conveyance period of a full turn of the feeding roller 60 and the distance by which the recording medium P is conveyed in the conveyance period. The CPU 32 is connected to the ROM 33, the RAM 34, the flash memory 35 and the G/A 36 via a bus line 45.

The G/A 36 outputs recording data (drive signal) for recording the image data stored in the image memory 37 on the recording medium P, transfer clock synchronized with the recording data, latch signal, parameter signal for generating a basic drive wave signal and ejection timing signal to be output with a predetermined cycle according to timing signal transferred from the CPU 32 and image data stored in the image memory 37 and transfers these signals to the carriage substrate 13 on which the head driver is mounted.

Additionally, the G/A 36 stores the video data transferred thereto from an external apparatus such as a computer via an interface (I/F) 44, which may be a USB, in the image memory 37. Then, the G/A 36 generates a data reception interrupt signal according to the data transferred via the I/F 44 from the computer and transfers the signal to the CPU 32. The signals that are exchanged between the G/A 36 and the carriage substrate 13 are transmitted via a harness cable that connect them to each other.

The carriage substrate 13 is a substrate for driving the ink jet head 6 by means of the head driver (drive circuit) mounted on the substrate 13. The ink jet head 6 and the head driver are connected to each other by a flexible wiring board 19 carrying a wiring pattern of copper foil formed on a 50 to 150 μm thick polyimide film. The head driver is controlled by the G/A 36 that is mounted on the main body side control substrate 12 so as to apply a drive pulse showing a waveform that matches the selected recording mode to the piezoelectric actuator of the ink jet head 6. Then, ink is ejected at a predetermined rate.

Now, the method of detecting the error of the conveyance distance according to the present embodiment will be described below by referring to FIGS. 5A and 5B, and FIGS. 6A and 6B. In the present embodiment, the error of the conveyance distance is assumed to be caused only by variation in the error of the dimension of the feeding roller 60. The detecting method in the present embodiment includes a first method and a second method.

Figure 5A:
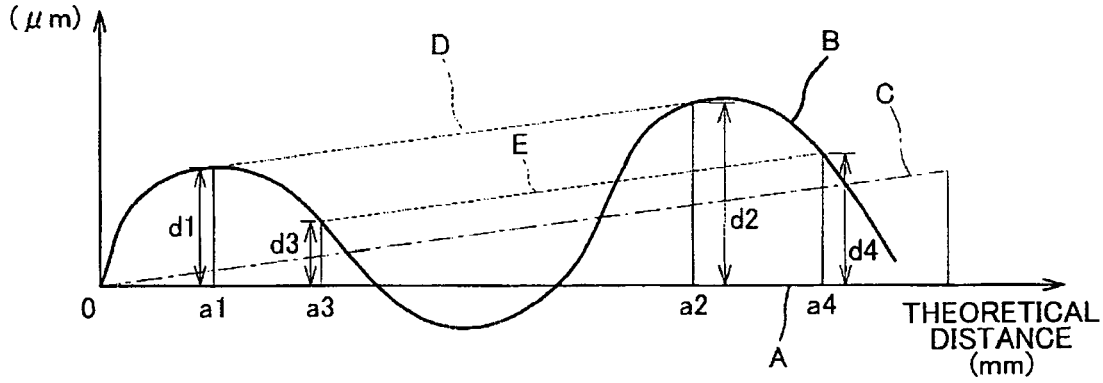
FIG. 5A is a graph showing a relation between a theoretical distance by which the recording medium should be conveyed and an actual distance by which the recording medium is actually conveyed in a first method.

The first method will be described by referring to FIGS. 5A, 6A and 6B. FIG. 5A is a graph showing a relation between a theoretical distance by which the recording medium P should be conveyed and an actual distance by which the recording medium P is actually conveyed. In FIG. 5A, a horizontal axis A indicates a theoretical distance with a unit of mm (millimeter) and a vertical axis indicates a difference of the actual distance from the theoretical distance with a unit of μm (micrometer). The theoretical distance means a distance by which the recording medium P is conveyed as the feeding roller 60 having neither a dimensional error nor an eccentricity rotates.

The solid line B shows a difference of the actual distance from the corresponding theoretical distance, when the feeding roller 60 has both the dimensional error and the eccentricity. The dotted chain line C shows a difference of the actual distance from the corresponding theoretical distance, when the feeding roller has the dimensional error but does not have any eccentricity. Thus, the solid line B takes a sinusoidal curve with a baseline thereof agreeing with the dotted chain line C.

In FIG. 5A, when the theoretical distance is "a1", the actual distance differs from "a1" by "d1". When the feeding roller 60 makes a full turn in a state that the theoretical distance is "a1", the theoretical distance becomes "a2". When the theoretical distance is "a2", the actual distance differs from "a2" by "d2". Since the feeding roller 60 has made a full turn, there is no influence of the eccentricity between "d1" and "d2". Thus, the broken line D connecting the two positions on the solid line B corresponding to "a1" and "a2" runs in parallel with the dotted chain line C.

Similarly, in FIG. 5A, when the theoretical distance is "a3", the actual distance differs from "a3" by "d3". When the feeding roller 60 makes a full turn in a state that the theoretical distance is "a3", the theoretical distance becomes "a4". When the theoretical distance is "a4", the actual distance differs from "a4" by "d4". Thus, the broken line E connecting the two positions on the solid line B corresponding to "a3" and "a4" runs in parallel with the dotted chain line C.

When the feeding roller 60 rotates a first printing turn, the theoretical distance is "a1" or "a3" in the present embodiment. Then, when the feeding roller 60 makes a full turn in a state that the theoretical distance is "a1" or "a3", that is, the feeding roller 60 rotates a second printing turn, the theoretical distance is "a2" or "a4". Note that though the above description has been made with respect to the case in which the feeding roller 60 makes a full turn, the feeding roller 60 may make N turns (N being a natural number not smaller than 1).

Thus, by measuring both the actual distance (a1+d1, or, a3+d3) and the actual distance (a2+d2, or, a4+d4), the dotted chain line C showing a difference of the actual distance from the corresponding theoretical distance when the feeding roller has the dimensional error can be accurately detected.

Next, the method of measuring the difference of the actual distance from the theoretical distance will be described below by referring to FIGS. 6A and 6B. FIG. 6A is a schematic plan view of the ink jet head 6, showing the relative positions of the ink jet head 6 with respect to recording medium P when the conveyance distance is detected and FIG. 6B is a schematic plan view of the patterns printed on the recording medium P.

Figure 6A:
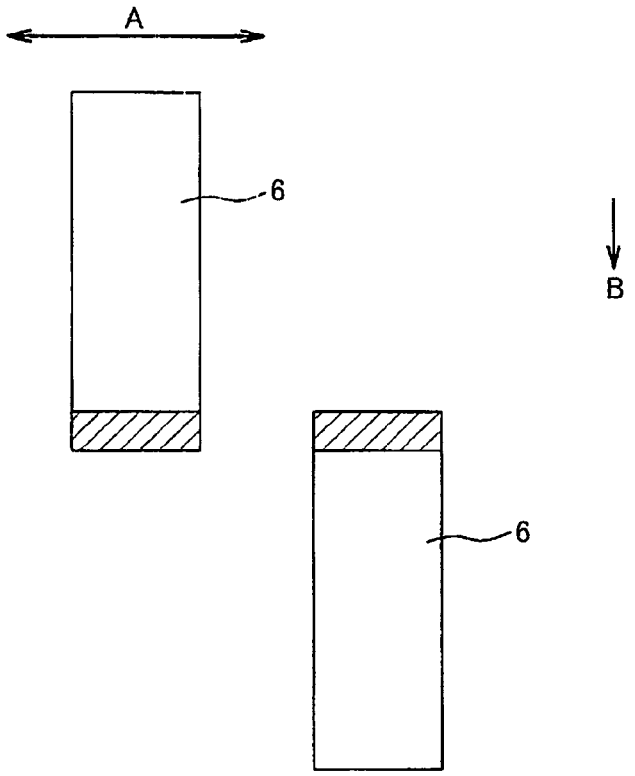
FIG. 6A shows the relative positions of the ink jet head with respect to recording medium when the conveyance distance is detected.

The printed patterns shown in FIG. 6A are depicted under an assumption that the ink jet head 6 is moved and the recording medium P were stationary, although the ink jet head 6 is stationary and the recording medium P is moved in reality. The upper figure in FIG. 6A shows the ink jet head 6 when the feeding roller 60 rotates the first printing turn and the lower figure in FIG. 6A shows the ink jet head 6 when the feeding roller 60 rotates the second printing turn. Solid lines and broke lines in FIG. 6B are printed at the shaded parts of the ink jet heads 6.

The recording medium P is conveyed as the feeding roller 60 rotates. If the feeding roller 60 is formed with the right dimension, the solid lines (a) and (b) in FIG. 6B are printed when the feeding roller 60 rotates the first printing turn.

In the present embodiment, a distance between the solid line (a) and the solid lines (b) when the feeding roller 60 is formed with the right dimension is measured in advance. The ink jet head 6 prints the solid line (a) and the solid lines (b), before printing broken lines in FIG. 6B.

Next, the ink jet head 6 prints (1) first broken lines when the feeding roller 60 rotates the second printing turn minus two worth micro turn Δ, (2) second broken lines when the feeding roller 60 rotates the second printing turn minus one worth micro turn Δ, and (3) third broken lines when the feeding roller 60 rotates the second printing turn.

Figure 6B:
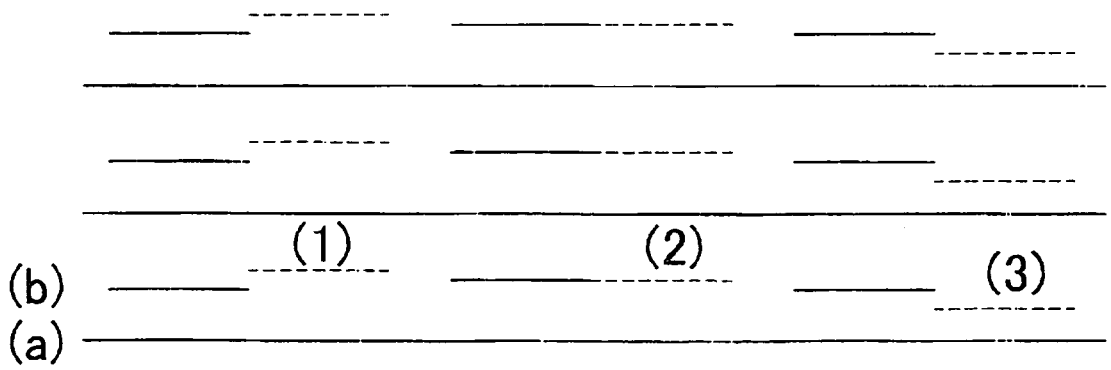
FIG. 6B is a schematic plan view of the patterns printed on the recording medium.

For the purpose of simplicity of explanation, the broken lines are printed at only three positions in FIG. 6B. However, the broken lines are actually printed at the number of positions. As seen from FIGS. 6A and 6B, the solid lines and the broken lines are printed so as to run in a direction perpendicular to the direction B of conveying the recording medium P.

The difference of the actual distance from the theoretical distance in full turn of the feeding roller 60 can be detected by selecting the broken line, with eyes, aligning with the solid line (b) and counting how long the selected broken line shifts from the solid line (b).

While the first method can be applied when the head length is greater than the distance by which the recording medium P is conveyed while the feeding roller 60 makes a full turn (to be referred to as conveyance cycle hereinafter), the first method is not used when the head length is smaller than the conveyance cycle. The second method can be applied regardless of the relationship between the head length and the conveyance cycle.

Figure 5B:
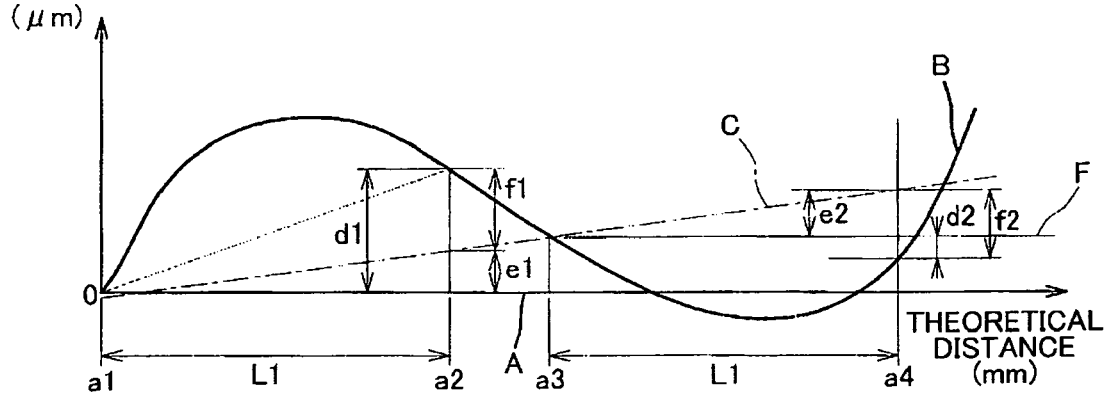
FIG. 5B is a graph showing a relation between a theoretical distance by which the recording medium should be conveyed and an actual distance by which the recording medium is actually conveyed in a second method.

Next, the second method will be described by referring to FIGS. 5B, 6A and 6B. FIG. 5B is a graph showing a relation between a theoretical distance by which the recording medium P should be conveyed and an actual distance by which the recording medium P is actually conveyed. As shown in FIG. 5B, the point on the horizontal axis A where the measurement is started is denoted by "a1", the point on the horizontal axis A separated from "a1" by the theoretical distance "L1" is denoted by "a2", the point on the horizontal axis A that corresponds to a half turn of the feeding roller 60 from "a1" is denoted by "a3" and the point on the horizontal axis A separated from "a3" by the theoretical distance "L1" is denoted by "a4".

When the feeding roller 60 rotates a first printing turn, the theoretical distance is "a1". Then, when the feeding roller 60 rotates by the theoretical distance "L1" in a state that the theoretical distance is "a1", that is, the feeding roller 60 rotates a second printing turn, the theoretical distance becomes "a2". When the theoretical distance is "a2", the actual distance differs from "a2" by "d1". As shown in FIG. 5B, the difference of the distance based on the dimensional error of the feeding roller 60 is "e1" and the difference of the distance based on the eccentricity of the feeding roller 60 is "f1".

On the other hand, when the feeding roller 60 makes a half turn in a state that the theoretical distance is "a1", that is, the feeding roller 60 rotates a third printing turn, the theoretical distance becomes "a3". When the feeding roller 60 rotates by the theoretical distance "L1" in a state that the theoretical distance is "a3", that is, the feeding roller 60 rotates a fourth printing turn, the theoretical distance becomes "a4". When the theoretical distance is "a4", the actual distance differs from "a4" by "d4". As shown in FIG. 5B, the difference of the distance based on the dimensional error of the feeding roller 60 is "e2" and the difference of the distance based on the eccentricity of the feeding roller 60 is "f2".

Of the above difference, "f1" and "f2" based on the eccentricity of the feeding roller 60 show respective polarities that are different from each other and the same absolute value. The solid line B is a sinusoidal curve with the base line thereof agreeing with the dotted chain line C and all the equidistant points from the zero-crossing point on the solid line B are separated from the base line of the sinusoidal curve by the same distance. Then, all the distances from the respective equidistant points to the point of intersection of the centerline of the two straight lines connecting the equidistant points are equal.

Additionally, "e1" and "e2" are equal to each other in terms of both polarity and absolute value. Thus, the following equation is obtained by adding "d1" and "d2".

$$d1+d2=(e1+f1)+(e2+f2)=2e1$$

Thus, an equation of e1=(d1+d2)/2 can be obtained. The difference of the distance based on the dimensional error of the feeding roller 60 from which the error based on the eccentricity of the feeding roller 60 has been removed can be detected.

Next, the method of measuring the difference of the actual distance from the theoretical distance will be described below by referring to FIGS. 6A and 6B.

As the first method, a distance between the solid line (a) and the solid lines (b) when the feeding roller 60 is formed with the right dimension is measured in advance. The ink jet head 6 prints the solid line (a) and the solid lines (b), before printing broken lines in FIG. 6B.

Next, the ink jet head 6 prints (1) first broken lines when the feeding roller 60 rotates the second printing turn minus two worth micro turn Δ, (2) second broken lines when the feeding roller 60 rotates the second printing turn minus one worth micro turn Δ, and (3) third broken lines when the feeding roller 60 rotates the second printing turn.

For the purpose of simplicity of explanation, the broken lines are printed at only three positions in FIG. 6B. However, the broken lines are actually printed at the number of positions. As seen from FIGS. 6A and 6B, the solid lines and the broken lines are printed so as to run in a direction perpendicular to the direction B of conveying the recording medium P.

A first difference "d1" of the actual distance from the theoretical distance when the feeding roller 60 rotates by the theoretical distance "L1" in a state that the theoretical distance is "a1" can be detected by selecting the broken line, with eyes, aligning with the solid line (b) and counting how long the selected broken line shifts from the solid line (b).

Thereafter, the feeding roller 60 rotates a half turn, that is, the feeding roller 60 rotates the third printing turn in a state before the feeding roller 60 rotates the second printing turn, and the ink jet head 6 prints the solid line (a) and the solid lines (b) again, before printing the broken lines in FIG. 6B.

Next, the ink jet head 6 prints (1) first broken lines when the feeding roller 60 rotates the fourth printing turn minus two worth micro turn Δ, (2) second broken lines when the feeding roller 60 rotates the fourth printing turn minus one worth micro turn Δ, and (3) third broken lines when the feeding roller 60 rotates the fourth printing turn.

For the purpose of simplicity of explanation, the broken lines are printed at only three positions in FIG. 6B. However, the broken lines are actually printed at the number of positions. As seen from FIGS. 6A and 6B, the solid lines and the broken lines are printed so as to run in a direction perpendicular to the direction B of conveying the recording medium P.

A second difference "d2" of the actual distance from the theoretical distance when the feeding roller 60 rotates by the theoretical distance "L1" in a state that the theoretical distance is "a3" can be detected by selecting the broken line, with eyes, aligning with the solid line (b) and counting how long the selected broken line shits from the solid line (b).

While the first difference "d1" and the second difference "d2" may include the difference based on the eccentricity of the feeding roller 60, the difference "f1" based on the eccentricity included in the first difference and the difference "f2" based on the eccentricity included in the second difference show respective polarities that are different from each other without fail and the same absolute value.

Thus, by using the equation: e1=(d1+d2)/2, the difference "e1" of the actual distance from the theoretical distance that does not include the difference "f1" and "f2" based on the eccentricity of the feeding roller 60 can be accurately detected.

While both "a1" and "a3" are located at the center of the swinging motion of the feeding roller 60 due to eccentricity and the zero-crossing point in FIG. 5B, the above-defined relationship holds true if the feeding roller 60 rotates the third printing turn (a half turn) from a state before the feeding roller 60 rotates the second printing turn.

Now, the printing process for detecting the error of the conveyance distance that is executed by the CPU 32 of the color ink jet printer 1 will be described below by referring to FIGS. 7 and 8. The printing process is executed as the operator operates the operation panel 45 before the shipment or after a repair.

Firstly, whether the head length is greater than the conveyance cycle or not is determined (S1). Data with respect to the head length and the conveyance cycle is stored in the flash memory 35. If the head length is greater than the conveyance cycle (S1: Yes), the above-described first method is employed for detecting the error of the conveyance distance. If, on the other hand, the head length is not greater than the conveyance cycle (S1: No), the above-described second method is employed for detecting the conveyance error.

When the first method is used to detect the error of the conveyance distance, firstly the feeding roller 60 is driven to convey the recording medium P by a predetermined length (S2). The recording medium P is conveyed to the printing starting point for the ordinary printing operation by conveying the recording medium P by the predetermined length. Firstly, a check pattern of the solid lines (a) and (b) shown in FIG. 6B is printed at this starting point (S3).

Then, the feeding roller 60 is driven to convey the recording medium P to the position that corresponds to the distance equal to the conveyance cycle less Δ×n (S4), where "Δ" is a micro turn and "n" is a positive integer. Thereafter, a check pattern of the broken lines shown in FIG. 6B is printed (S5). While this process will be described in greater detail hereinafter by referring to FIG. 8, the check pattern of the broken lines shown in FIG. 6B is printed at a total of 2n positions including n positions that are separated from each other by "Δ" and are shorter than the conveyance cycle and "n" positions that are separated from each other by "Δ" and are longer than the conveyance cycle. Then, the error of the conveyance distance can be detected by comparing the 2n printed pattern with the image obtained as a result of the processing step of S3. The printing process ends when the check pattern printing process of S5 ends.

If, on the other hand, the head length is determined to be not greater than the conveyance cycle in the processing step of S1 (S1: No), the second method is used to detect the error of the conveyance distance. Firstly, the feeding roller 60 is driven to convey the recording medium P to a first starting position corresponding to "a1" in FIG. 5B (S11), and then, a check pattern of solid lines (a) and (b) shown in FIG. 6B is printed at the first starting position (S12).

Then, the recording medium P is conveyed from the first starting position to the position that corresponds to the value equal to the predetermined length L1 less Δ×n (S13) and a check pattern printing process is executed at the position (S14). The printing process of S14 is a process for printing a check pattern of the broken line shown in FIG. 6B at 2n positions like the processing step of S5.

Then, the feeding roller 60 is driven to make a half turn to convey the recording medium P from the first starting position to a second starting position (S15) and a check pattern of the solid lines shown in FIG. 6B is printed at the second starting position (S16). Thereafter, the recording medium P is conveyed from the second starting position to the position that corresponds to the value equal to the predetermined length L1 less Δ×n (S17) and a check pattern printing process is executed there (S18). The printing process of S18 is a process similar to that of S14. The printing process ends when the processing step of S18 ends.

Now, the check pattern printing process will be described below by referring to FIG. 8. The check pattern printing process is a subroutine. Firstly, 1st broken line shown in FIG. 6B is printed at the position to which the recording medium P is conveyed (S21). Then, 1 is subtracted from the value of 2n (S22) and whether the value of 2n is equal to 0 or not is determined (S23). If the value of 2n is equal to 0 (S23: Yes), the check pattern printing process is ended and the original process is resumed. If, on the other hand, the value of 2n is not equal to 0 (S23: No), the recording medium P is conveyed from that position by Δ (S24) and the process returns to the processing step S21.

As described above, by referring to the flowcharts of FIGS. 7 and 8, when the head length is longer than the conveyance cycle, the error of the conveyance distance is detected by means of the first method. In other words, the check pattern of the solid lines is printed at the starting position and then the feeding roller 60 is driven to make exactly a full turn in order to convey the recording medium P from the starting position. Then, the check pattern of the broken lines is printed at the position to which the recording medium P is conveyed.

Then, the error of the conveyance distance can be detected by visually checking the printed check patterns. Thus, as a result, the error of the conveyance distance can be accurately detected even if the feeding roller 60 has eccentricity.

The detected error of the conveyance distance is then stored in the correction value memory 35*a* of the flash memory 35 and retrieved therefrom before a printing is executed so that the recording medium P is conveyed accurately.

When the head length is not greater than the conveyance cycle, the error of the conveyance distance is detected by means of the second method. In other words, the check pattern of the solid lines is printed at the first starting position and then the check pattern of the broken lines is printed at the position that is separated from the first starting position by a predetermined distance. Then, the first difference "d1" can be detected by visually checking the printed check patterns. Thereafter, the feeding roller 60 is driven to make a half turn to convey the recording medium P from the first starting position to the second starting position and the check pattern of the solid lines is printed again at the position. Then, the check pattern of the broken lines is printed at the position that is separated from the second starting position by the predetermined distance. Then, the second difference "d2" can be detected by visually checking the printed check patterns. Thus, the error of the conveyance distance can be accurately detected by computationally determining the average of the first difference "d1" and the second difference "d2" even if the feeding roller 60 has eccentrically.

While the invention has been described in detail with reference to the specific embodiment thereof, it would be apparent to those skilled in the art that various changes and modifications may be made therein without departing from the spirit of the invention.

For example, the image forming apparatus 1 is a color ink jet printer in the above embodiment, the apparatus 1 may alternatively be a monochromatic ink jet printer, a facsimile apparatus or a copying machine so long as the apparatus 1 is adapted to sequentially convey a recording medium P by driving the feeding roller 60 to rotate and form an image on the recording medium P.

While the ink head 6 is adapted to repeatedly reciprocate in the main scanning direction in the above-described embodiment, an image forming apparatus according to the present invention may alternatively have a head that is sufficiently long and held stationary in the main scanning direction.

While the image formed at the first position and the image formed at the second position are made to partly overlap each other in the direction of conveying the recording medium P and the conveyance error is detected by means of the overlap in the above-described embodiment, some other method that is adapted to detect the distance between the image printed at the first position and the image printed at the second position may alternatively be used. For example, a check pattern may be printed on a recording medium P by means of an image forming apparatus whose feeding roller 60 is not eccentric or an image forming apparatus in which the eccentricity of the feeding roller 60 thereof has already been corrected and the recording medium P is mounted in the image forming apparatus for detecting the conveyance error in order to detect the conveyance error by printing a check pattern at the first and second positions.

What is claimed is:

1. A method of compensating for an error of a conveyance distance of a recording medium in an image forming apparatus, the image forming apparatus including: a feeding roller rotatably disposed to convey the recording medium in a conveying direction, the feeding roller including a rotational axle that is eccentric and a peripheral surface having an actual entire peripheral length that is different from a theoretical entire peripheral length; and a recording unit having a head length over which an image can be printed in the conveying direction, the head length being longer than the theoretical entire peripheral length, the method comprising:

rotating the feeding roller one turn or N turns, N being a positive integer greater than 1;

printing a plurality of second images on the recording medium before and after the feeding roller has been rotated said one turn or N turns, on the recording medium, a first image being printed in advance showing a reference distance corresponding to a distance equal to or N times the theoretical entire peripheral length;

determining a difference of the actual entire peripheral length from the theoretical entire peripheral length based on both the first image and the plurality of second images; and adjusting, based on the difference of the actual entire peripheral length from the theoretical entire peripheral length, a rotational amount of the feeding roller.

2. The method according to claim 1, wherein in the determining step, the difference is determined by bringing, on a step-by-step basis, the first image and the second image into a possible closest positional coincidence in the conveying direction.

3. A method of compensating for an error of a conveyance distance of a recording medium in an image forming apparatus, the image forming apparatus including: a feeding roller rotatably disposed to convey the recording medium in a conveying direction, the feeding roller including a rotational axle that is eccentric and a peripheral surface having an actual entire peripheral length that is different from a theoretical entire peripheral length; and a recording unit having a head length over which an image can be printed in the conveying direction, the head length being shorter than the theoretical entire peripheral length, the method comprising:

a first rotating step of rotating the feeding roller one turn or M turns, M being a positive integer greater than 1;

a first printing step of printing a plurality of second images on the recording medium before and after the feeding roller has been rotated said one turn or M turns, on the recording medium, a first image being printed in advance showing a reference distance corresponding to a distance equal to or N times the theoretical entire peripheral length, N being a positive integer greater than 1;

a second rotating step of rotating the feeding roller 0.5 or (N−0.5) turns from a position at which the feeding roller is located before the second rotating step;

a second printing step of printing a third image on the recording medium after the feeding roller has been rotated said 0.5 or (N−0.5) turns;

a third rotating step of rotating the feeding roller one turn or M turns after the third image has been printed;

a third printing step of printing a plurality of fourth images on the recording medium before and after the third image has been printed and the feeding roller has been rotated said one turn or M turns;

a first determining step of determining a first difference of the actual entire peripheral length from the theoretical entire peripheral length based on both the first image and the plurality of second images;

a second determining step of determining a second difference of the actual entire peripheral length from the theoretical entire peripheral length based on both the third image and the plurality of fourth images;

a third determining step of determining a difference of the actual entire peripheral length from the theoretical entire peripheral length based on both the first difference and the second difference; and an adjusting step of adjusting, based on the difference of the actual entire peripheral length from the theoretical entire peripheral length, a rotational amount of the feeding roller.

4. The method according to claim 3, wherein in the first and second determining steps, the first difference and the second difference is determined by bringing, on a step-by-step basis, the first image and the second images, and the third image and the fourth images into a possible closest positional coincidence, respectively, in the conveying direction.

5. An image forming apparatus comprising:

a feeding roller rotatably disposed to convey a recording medium in a conveying direction, the conveying roller including a rotational axle that is eccentric and a peripheral surface having an actual entire peripheral length that is different from a theoretical entire peripheral length;

a recording unit having a head length over which an image can be printed in the conveying direction, the head length being longer than the theoretical entire peripheral length;

a controller configured to control the feeding roller to rotate one turn or N turns, N being a positive integer greater than 1, and control the recording unit to print a plurality of second images on the recording medium before and after the feeding roller has been rotated said one turn or N turns, on the recording medium, a first image being printed in advance showing a reference distance corresponding to a distance equal to or N times the theoretical entire peripheral length.

6. The image forming apparatus according to claim 5, wherein the controller controls the feeding roller to convey the recording medium relative to the recording unit on a step-by-step basis so that the plurality of second images are brought into a possible closest positional coincidence with the first image in the conveying direction.

7. An image forming apparatus comprising:

a feeding roller rotatably disposed to convey a recording medium in a conveying direction, the conveying roller including a rotational axle that is eccentric and a peripheral surface having an actual entire peripheral length that is different from a theoretical entire peripheral length;

a recording unit having a head length over which an image can be printed in the conveying direction, the head length being shorter than the theoretical entire peripheral length; and a controller configured to:

control the feeding roller to rotate one turn or M turns, M being a positive integer greater than 1, control the recording unit to print a plurality of second images on the recording medium before and after the feeding roller has been rotated said one turn or M turns, on the recording medium, a first image being printed in advance showing a reference distance corresponding to a distance equal to or N times the theoretical entire peripheral length, N being a positive integer greater than 1, control the feeding roller to rotate 0.5 or (N−0.5) turns from a position at which the feeding roller is located before the 0.5 or (N−0.5) rotation, control the recording unit to print a third image on the recording head after the feeding roller has been rotated said 0.5 or (N−0.5) turns, control the feeding roller to rotate one turn or M turns, and control the recording unit to print a plurality of fourth images on the recording medium before and after the third image has been printed and the feeding roller has been rotated said one turn or M turns.

8. The image forming apparatus according to claim 7, wherein the second controller controls the feeding roller to convey the recording medium relative to the recording unit on a step-by-step basis so that the first image and the plurality of second images are brought into a possible closest continuity with the first image in the conveying direction and so that the third image and the plurality of fourth images are brought into a possible closest positional coincidence in the conveying direction.

9. A non-transitory computer readable medium provided in an image forming apparatus, the image forming apparatus including: a feeding roller rotatably disposed to convey the recording medium in a conveying direction, the feeding roller including a rotational axle that is eccentric and a peripheral surface having an actual entire peripheral length that is different from a theoretical entire peripheral length; and a recording unit having a head length over which an image can be printed in the conveying direction, the head length being longer than the theoretical entire peripheral length, the non-transitory computer readable medium comprising instructions to make the image forming apparatus implement the steps of:

rotating the feeding roller one turn or N turns, N being a positive integer greater than 1;

printing a plurality of second images on the recording medium before and after the feeding roller has been rotated N turns, on the recording medium, a first image being printed in advance showing a reference distance corresponding to a distance equal to or N times the theoretical entire peripheral length;

determining a difference of the actual entire peripheral length from the theoretical entire peripheral length, based on both the first image and the plurality of second images.

10. The non-transitory computer readable medium according to claim 9, wherein the steps further comprise adjusting, based on the difference of the actual external dimension from the theoretical external dimension, a rotational amount of the feeding roller for conveying the recording medium relative to the recording unit, and the difference is determined by bringing, on a step-by-step basis, the first image and the plurality of second images into a possible closest positional coincidence in the conveying direction.

11. A non-transitory computer readable medium in an image forming apparatus, the image forming apparatus including: a feeding roller rotatably disposed to convey the recording medium in a conveying direction, the feeding roller including a rotational axle that is eccentric and a peripheral surface having an actual entire peripheral length that is different from a theoretical entire peripheral length; and a recording unit having a head length over which an image can be printed in the conveying direction, the head length being shorter than the theoretical entire peripheral length, the computer readable medium comprising instructions to make the image forming apparatus implement the steps of:

rotating the feeding roller one turn or M turns, M being a positive integer greater than 1;

printing a plurality of second images on the recording medium before and after the feeding roller has been rotated said one turn or M turns, on the recording medium, a first image being printed in advance showing a reference distance corresponding to a distance equal to or N times the theoretical entire peripheral length, N being a positive integer greater than 1;

rotating the feeding roller 0.5 or (N−0.5) turns from a position at which the feeding roller is located before the 0.5 or (N−0.5) rotating step;

printing a third image on the recording medium after the feeding roller has been rotated said 0.5 or (N−0.5) turns;

rotating the feeding roller one turn or M turns after the third image has been printed;

printing a plurality of fourth images on the recording medium before and after the third image has been printed and the feeding roller has been rotated said one turn or M turns;

determining a first difference of the actual entire peripheral length from the theoretical entire peripheral length based on both the first image and the plurality of second images;

determining a second difference of the actual entire peripheral length from the theoretical entire peripheral length based on both the third image and the plurality of fourth images; and determining a difference of the actual entire peripheral length from the theoretical entire peripheral length based on both the first difference and the second difference.

12. The non-transitory computer readable medium according to claim 11, wherein the steps further comprise adjusting, based on the difference of the actual external dimension from the theoretical external dimension, a rotational amount of the feeding roller for conveying the recording medium relative to the recording unit, and the difference is determined by bringing, on a step-by-step basis, the first image and the plurality of second images into a possible closest continuity in the conveying direction and the third image and the plurality of fourth images into a possible closest positional coincidence in the conveying direction.

* * * * *